United States Patent [19]

Wauchope et al.

[11] Patent Number: 4,679,471

[45] Date of Patent: Jul. 14, 1987

[54] LATHE FOR GENERATING ASPHERICAL SURFACES

[75] Inventors: Stirling G. Wauchope; Malcolm J. McLean, both of Oxford, England

[73] Assignee: Robertson Engineering (Thame) Limited, Oxford, England

[21] Appl. No.: 740,271

[22] PCT Filed: Sep. 19, 1984

[86] PCT No.: PCT/GB84/00317

§ 371 Date: May 14, 1985

§ 102(e) Date: May 14, 1985

[87] PCT Pub. No.: WO85/01237

PCT Pub. Date: Mar. 28, 1985

[30] Foreign Application Priority Data

Sep. 19, 1983 [GB] United Kingdom ..... 8325027

[51] Int. Cl.[4] ..... B23B 5/40

[52] U.S. Cl. ..... 82/12

[58] Field of Search ..... 82/12, 1 C; 51/33 R, 51/55, 124 L

[56] References Cited

U.S. PATENT DOCUMENTS

| | | | |
|---|---|---|---|
| 1,537,059 | 5/1925 | Bausch | 82/12 |
| 1,998,395 | 4/1935 | Houchin | 82/12 |
| 3,664,065 | 5/1972 | Baker | 51/100 R |
| 4,051,751 | 10/1977 | Estrada | 82/12 |
| 4,068,413 | 1/1978 | Suddarth | 51/55 |
| 4,114,486 | 9/1978 | Hooker | 82/12 |
| 4,274,313 | 6/1981 | Vulic | 82/12 |

FOREIGN PATENT DOCUMENTS

| | | |
|---|---|---|
| 44207 | 1/1982 | European Pat. Off. . |
| 2212772 | 7/1974 | France . |
| 2378607 | 8/1978 | France . |
| 149141 | 9/1982 | Japan . |
| 1290685 | 9/1972 | United Kingdom . |

*Primary Examiner*—Nicholas P. Godici
*Assistant Examiner*—Jerry Kearns
*Attorney, Agent, or Firm*—Biebel, French & Nauman

[57] ABSTRACT

A lathe for cutting an aspherical surface on a workpiece, such as a contact lens blank, comprises a headstock mounted for linear reciprocating movement relative to a radius cartridge having a tool post for mounting a cutting tool so that the tool can swing at a preset radius about an axis perpendicular to the rotational axis of the headstock spindle in the same plane as the spindle axis. The radius cartridge is coupled to the headstock via an eccentric mechanism, a connecting rod and a slidable bearing assembly for the headstock leadscrew so that the headstock is reciprocated in synchronism with oscillating movement of the radius cartridge to cause the tool to cut a predetermined aspherical surface on the workpiece. The headstock may be intermittently advanced towards the cutting tool, independently of its reciprocating movement and while the cutting tool is stationary, by means of the leadscrew in order to provide for incremental removal of material from the workpiece.

12 Claims, 5 Drawing Figures

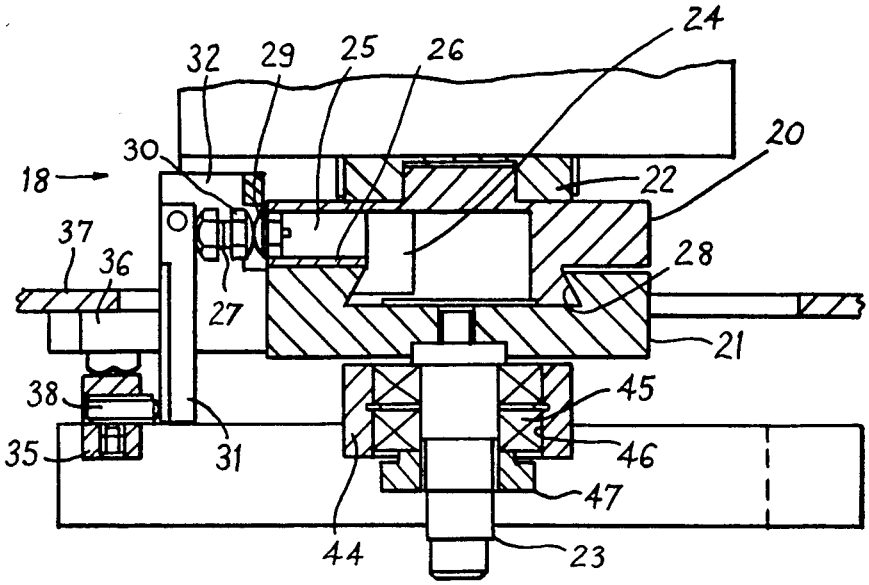
Fig.2
Fig.5
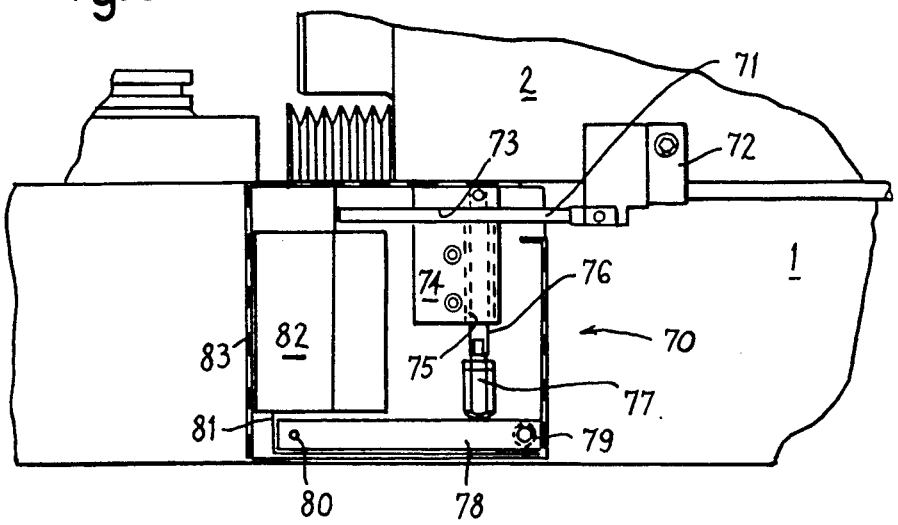

LATHE FOR GENERATING ASPHERICAL SURFACES

BACKGROUND OF THE INVENTION

The present invention relates to lathes for cutting aspherical surfaces or, more precisely, truncated aspherical surfaces on workpieces, for example, for the production of lenses, contact lens moulds, reflectors and the like.

Typically, a lathe for cutting spherical surfaces for such purposes as contact lenses, comprises a headstock mounted on a slideway on the lathe bed enabling the headstock to move parallel to its spindle axis under the control of a lead screw journalled in a fixed bearing and rotatable, for example, by a handle. A tool holder or tool post is mounted on a radius cartridge so that a cutting tool clamped in the post can swing at a preselected radius about an axis disposed perpendicularly to the rotational axis of the headstock spindle and in the same plane as the spindle axis. By advancing the headstock in steps towards the cutting tool, which is swung about the axis of the radius cartridge, a workpiece clamped in a chuck or collet at the end of the spindle can be cut to either a truncated concave or convex spherical surface depending on the position of the tool post with respect to the axis of the radius cartridge. The purpose of advancing the headstock, in this instance, is for removing increments of material from the workpiece and it is important to note that, whilst the radius cartridge is rotated, the headstock is maintained stationary.

Requirements have arisen for cutting aspherical surfaces, such as, truncated elipsoids or other conic sections. For example, such surfaces are desirable in the case of contact lenses in order accurately to conform the central part of a contact lens surface to an eyeball, which is not normally spherical, and to provide edge lift at the periphery of the contact lens to permit access of tear fluid to the underneath of the lens for lubrication purposes. In such cases, the objective is to "flatten" or "steepen" the surface being cut, away from the shape of a true sphere, as the diameter of the surface increases.

Two main arrangements are currently used to produce aspherical surfaces on workpieces. The first consists in linking the tool post of a lathe of the type described above to a cam or other mechanism so that the radius at which the tool is cutting changes as the radius cartridge rotates. Such an arrangement is described in U.S. Pat. No. 4,114,486. The disadvantage of this arrangement is that different cams or complicated adjustments are required for aspherical surfaces of different eccentricities so that it tends to be inflexible. Moreover, because of the small movements involved, movment of the tool post to change the cutting radius is difficult to control and tends to be unstable resulting in a relatively poor finish to the cut surface.

The second main arrangement currently used employs a lathe with a normal cross-slide, instead of a radius cartridge, and the tool position is controlled by means of a pair of slides movable relatively at right angles to one another. Thus, by controlling the relationship of one axis with respect to the other an aspherical surface can be cut. It is usual to control the positions of the two slides either by means of an electrical servo or stepping motor. Either means generally requires microprocessor control and the input of a programme which specifies the shape of the aspherical surface to be cut.

Again, this arrangement tends towards inflexibility since, to change the shape of the aspherical surface being cut, it is necessary to change the programme for the microprocessor control. Also, such form of control is expensive.

Other arrangements for producing aspherical surfaces on workpieces are described in FR-A-No. 2378607 and 2212772, EP-A-No. 44207, U.S. Pat. Nos. 4,274,313, 4,068,413 and 3,664,065 and GB-A-No. 1290685.

SUMMARY OF THE INVENTION

It is an object of the present invention to provide a lathe construction for cutting aspherical surfaces, which affords improved flexibility in the shape of the aspherical surfaces which can be cut whilst, at the same time, enabling the structure of the lathe to be simplified.

The invention provides a lathe for cutting an aspherical surface on a workpiece, comprising a tool post mounted on a radius cartridge, whereby a cutting tool mounted on the tool post is swingable along an arc of predetermined radius transversely to the rotational axis of the spindle of the lathe headstock, the radius cartridge and headstock also being mounted for relative linear movement substantially parallel to the headstock spindle axis, and coupling means for producing simultaneous swinging movement of the tool post and relative linear movement of the radius cartridge and headstock, whereby a cutting tool mounted in the tool post is arranged to cut a predetermined aspherical surface on the workpiece.

Additionally, the lathe may include control means for linearly advancing the radius cartridge and the headstock relatively towards one another substantially parallel to the headstock spindle axis and independently of the movement produced by the coupling means, thereby to enable incremental removal of material from the workpiece mounted on the lathe spindle. Conveniently, the headstock is mounted for linear sliding movement parallel to its spindle axis, and the control means is operable to control such sliding movement of the headstock. With this arrangement the coupling means is preferably arranged to interconnect the radius cartridge and the control means so as to produce simultaneous swinging movement of the tool post and linear sliding movement of the headstock.

In a preferred embodiment of the lathe, the control means is a leadscrew mounted substantially parallel to the headstock spindle axis and coupled to the headstock so that rotation of the leadscrew produces sliding movement of the headstock. The leadscrew is journalled in bearing means which is mounted for linear sliding movement substantially parallel to the headstock spindle axis and is linked to the radius cartridge by the coupling means, whereby swinging movement of the radius cartridge produces linear movement of the bearing means and, hence, the headstock.

The coupling means may comprise a connecting member interconnecting the bearing means and the spindle of the radius cartridge. It is conveniently pivoted to connection conveniently the radius cartridge spindle via an eccentric mechanism which is adjustable radially of the radius cartridge spindle to enable setting of the pivot at an appropriate eccentricity with respect to the radius cartridge spindle axis to reciprocate the headstock with the required stroke to cut a predetermined aspherical surface on the workpiece mounted on the headstock spindle. To this end, the eccentric mechanism may comprise a pivot having its axis disposed substantially parallel to the axis of the radius cartridge spindle and mounted on the spindle for sliding movement transversely to the cartridge spindle axis and through a position in which the two axes are coaxial. Hence, the pivot may be adjusted to a desired eccentricity for producing reciprocation of the headstock and locking means may be provided for selectively locking the pivot in its adjusted position. The locking means may be arranged to be unlocked only when the path of sliding movement of the pivot is substantially parallel to the headstock spindle axis, and a second locking means may be provided for locking the headstock against sliding movement, whereupon rotation of the leadscrew can be used to adjust the eccentricity of the pivot.

With the present invention, an aspherical surface is cut on a workpiece by the combination of the swinging or oscillating movement of the cutting tool, mounted on the tool post, along an arc of predetermined radius and relative linear motion or reciprocating movement of the tool post and headstock parallel to the headstock spindle axis and along a path of predetermined length. Both these parameters are readily adjustable to provide for cutting of workpieces with aspheric surfaces of different dimensions.

BRIEF DESCRIPTION OF THE DRAWINGS

In order that the present invention may be more readily understood, reference will now be made to the accompanying drawings, in which:

FIG. 2 is an enlarged fragmentary sectional view of the adjustable eccentric mechanism controlling the stroke of the headstock, FIG. 5 is an enlarged fragmentary elevational view of the side of the lathe opposite to FIG. 1 and showing the headstock locking mechanism.

DETAILED DESCRIPTION OF THE PREFERRED EMBODIMENTS

Figure 1:
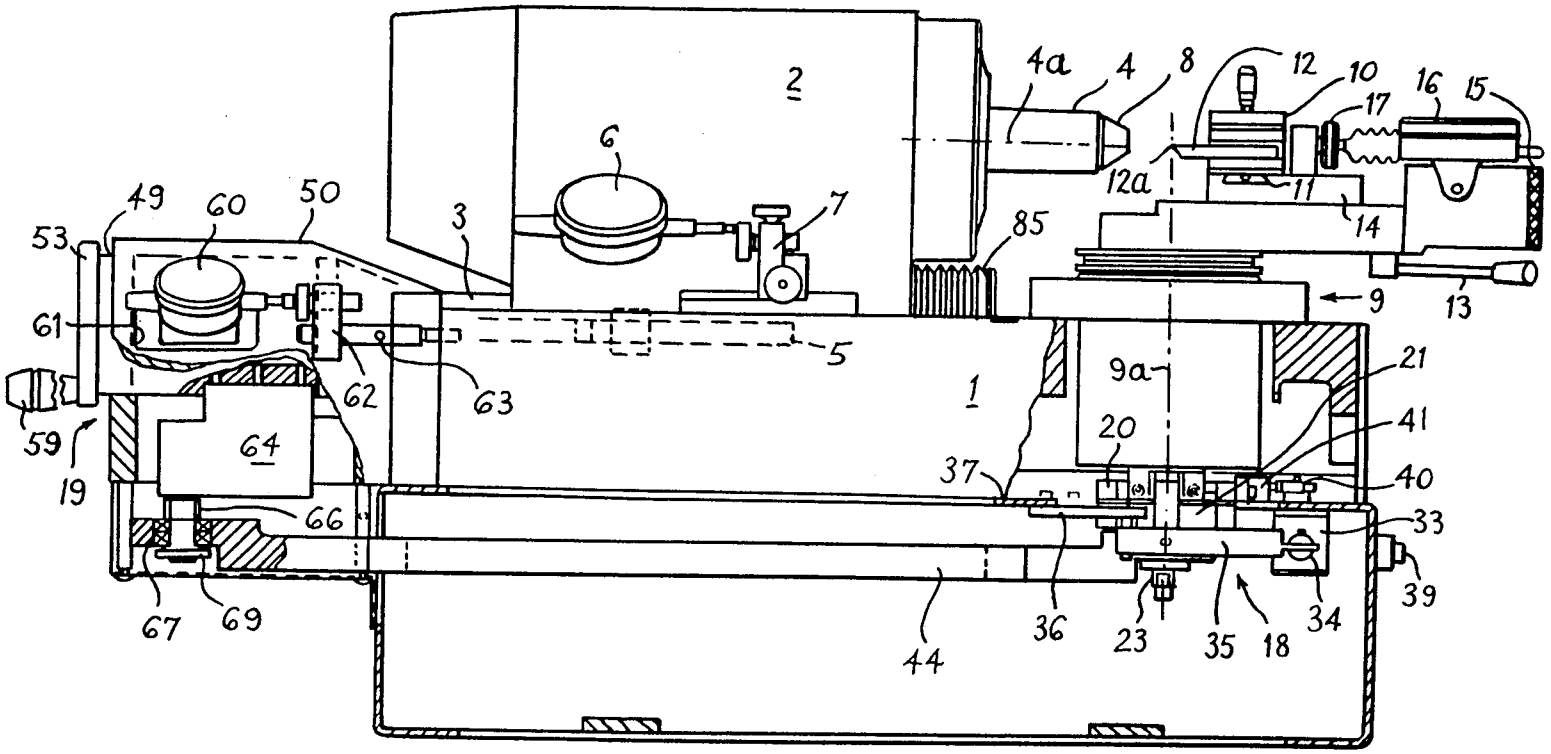
FIG. 1 is a side elevation, partially in section, of a lathe embodiying the invention.

Referring to FIG. 1 of the drawings, the lathe comprises a lathe bed 1, having a headstock 2 mounted on a slideway 3 on the top of the lathe bed so as as to be slideable parallel to the axis 4*a* of its spindle 4, which is driven by an electric motor, under the control of a leadscrew 5.

The slideway 3 comprises linear roller bearings which are protected at the inner end of the headstock by a bellows cover 85.

The movement of the headstock under the control of the leadscrew 5 is monitored by a dial indicator 6 fixed to the side of the headstock and cooperating with an adjustable anvil device 7 attached to the lathe bed.

A workpiece (not shown) in the form of a cylindrical blank may be mounted on the projecting end of the spindle 4, by means of a collet 8. Mounted in the lathe bed in front of the spindle 4 with its axis 9*a* perpendicular to and intersecting the spindle axis 4*a* is a radius cartridge 9 mounting a tool post 10. The jaws of the tool post are adjustable vertically, and the tool post, itself, is adjustable transversely, by means of the cross-slide 11, to position the cutting point 12*a* of a cutting tool 12 mounted on the tool post on the axis of the headstock spindle 4. The cutting tool can be swung about the axis 9*a* of the radius cartridge by means of a handle 13 and the radius of the arc described by the tool point 12*a* may be preset by adjusting the radial slide 14 of the radius cartridge with the knurled screw 15.

When the radius cartridge 9 is swung about its axis 9*a*, the cutting tool 12, in the absence of any other movement, cuts a spherical surface on a blank clamped in the collet 8 which is either concave or convex depending on whether the cutting tool projects in front of the axis 9*a* of the radius cartridge or is disposed behind it relative to the spindle 4. Two dial indicators 16 mounted on the radius cartridge and cooperating with anvils 17 fastened to the radial slide 14 enable setting of the radius of the arc of movement of the cutting tool.

To the extent described above, the lathe is of conventional construction and a more detailed description of the headstock, radius cartridge and the components thereof is believed unnecessary for the purposes of understanding the present invention.

The lathe illustrated in FIG. 1 is arranged to cut an aspheric surface on a blank or other workpiece clamped in the collet 8 by reciprocating the headstock 2, independently of any linear motion produced by turning the leadscrew 5, parallel to the spindle axis 4*a* as the radius cartridge 9 is turned to oscillate the cutting tool 12 along an arc of preset radius. To this end, the radius cartridge 9 is fitted with an adjustable eccentric mechanism 18 linked to a slidable bearing assembly 19 for the headstock leadscrew 5, as will now be more fully described.

Figure 3:
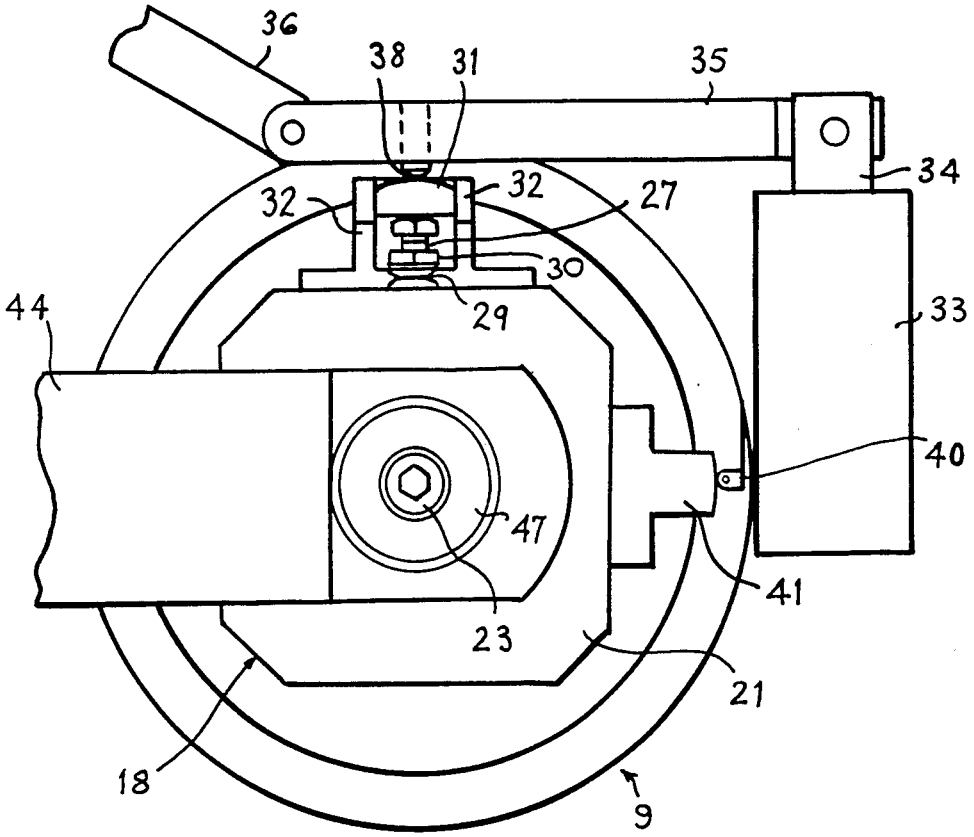
FIG. 3 is a fragmentary plan view of a mechanism shown in FIG. 2.

Referring to FIGS. 1, 2 and 3, the adjustable eccentric mechanism 18 comprises upper and lower dovetail slides 20, 21. The upper one 20 of which is fixed to the lower end of the radius cartridge spindle 22. The lower slide 21 mounts a downwardly projecting pivot pin 23 having its axis parallel to the axis 9*a* of the radius cartridge and movable with the lower slide through a position in which the axes of the radius cartridge and pivot pin are coaxial. Hence, the distance by which the pivot pin 23 is eccentric to the axis 9*a* of the radius cartridge and, consequently, the stroke of the headstock 2, is determined by the position of the lower slide 21 relative to the upper slide 20. The lower slide is locked in an adjusted position with respect to the upper slide by means of a wedge piece 24.

The latter is supported by a sleeve 25 slideably mounted in an opening 26 in the side of the upper slide 20 and fastened to the wedge by a screw 27. The latter projects from the upper slide and the wedge is held tight against the adjacent side of the dovetail groove 28 in the lower slide 21 by dished washers 29 also mounted on the screw 27 between a retaining nut 30 and the adjacent outside of the upper slide. A small rocker 31 pivoted between ears 32 projecting from the upper slide bears on the projecting end of the screw 27 and actuation of this rocker releases the locking wedge 24 so as to permit movement of the lower slide 21. The rocker is actuated by a solenoid 33 having its plunger 34 connected to one end of a lever 35 which has its opposite end pivoted to a support member 36 fastened to a frame member 37 of the lathe bed 1. Upon energisation of the solenoid 33 the lever 35 is pulled against the rocker 31 which thereupon depresses the screw 27 against the action of the dished washers 29 to release the locking wedge 24. The lever 35 bears on the rocker 31 via an adjustable pin 38.

The solenoid 33 is energised by actuation of a push-button switch 39 which is connected in series with a microswitch 40 actuated by a cam 41 fixed to the upper slide 20. The cam 41 is so positioned that the microswitch 40 is only actuated when the radius cartridge is centralised and the path of movement of the lower slide 21 is parallel to the axis 4*a* of the headstock spindle, and the eccentricity of the pivot pin 23 can only be adjusted when the lower slide is in this position.

Attached to the pivot pin 23 is one end of a connecting member 44 linking the eccentric mechanism to the leadscrew bearing assembly 19. The connecting member 44 is journalled on the pivot pin 23 by means of rolling bearings 45 housed in an opening 46 in the adjacent end of the connecting member and it is retained in its assembled position by a nut 47 screwed on to the pivot pin.

Figure 4:
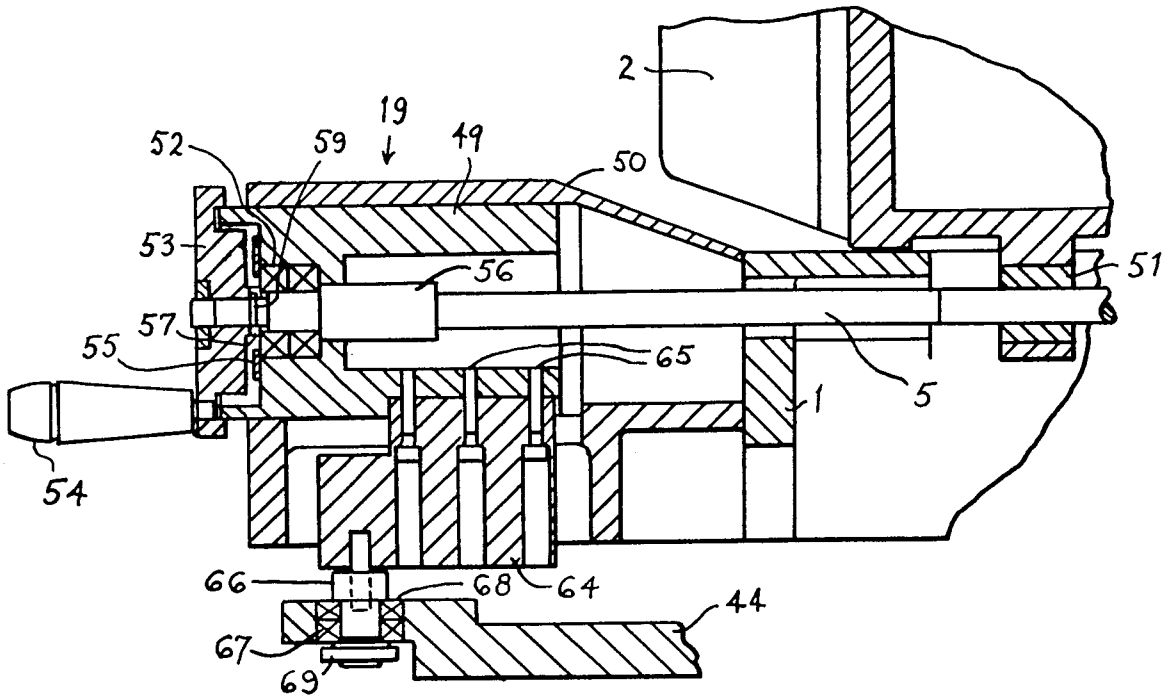
FIG. 4 is an enlarged fragmentary sectional view of the slidable bearing assembly for the leadscrew of the headstock.

Referring to FIGS. 1 and 4, the leadscrew 5 is supported, at its rear end in the bearing assembly 19, which includes a reaction block 49 slideably mounted in a housing 50 at the rear of the lathe bed 1, and projects forwardly from the bearing assembly, in cantilever fashion, and is coupled to the headstock 2 via a captive nut 51. It is rotatably supported in the reaction block 49 by rolling bearings 52 and has a wheel and handle assembly 53, 54 fastened to its rear end, where it projects from the reaction block, to permit turning of the leadscrew. The rolling bearings 52 are retained in their housing in the reaction block by an annular retainer 55 fastened to the rear end of the reaction block and are engaged at oppsoite ends by a flange 56 on the leadscrew and a collar 57 of the wheel 53, which together prohibit axial movement of the leadscrew relative to the bearing assembly. The wheel 53 is fastened to the leadscrew by a nut 58 and a pin 59 engaged in aligned holes in the collar 57 and the leadscrew shank.

Axial movement of the bearing assembly 19 is monitored by a dial indicator 60 disposed outside the housing 50 and mounted on the reaction block 49 via an opening 61 in the housing wall. The feeder of this dial indicator cooperates with an adjustable anvil device 62 mounted on a support rod 63 projecting from the lathe bed.

The adjacent end of the connecting member 44 is coupled to the reaction block 49 via a spacing block 64, fastened to the reaction block by screws 65, and a pivot pin 66 mounted on the bottom of the spacer block. The adjacent end of the connecting member is journalled on this pivot pin by means of rolling bearings 67 housed in an opening 68 in the connecting member and it is secured in its assembled position by a retaining nut 69.

So as to permit turning movement of the leadscrew 5 also to be used to adjust the reaction block 49 and, hence, the eccentric mechanism 18, the lathe is equipped with a locking or braking device 70 for the headstock 2. This is illustrated in FIG. 5. It comprises a brake rod 71 secured to the side of the headstock 2 by a mounting block 72 and projecting along the adjacent side of the lathe bed parallel to the axis 4*a* of the headstock spindle. The brake rod is slideable in a close fitting bore 73 in a brake block 74 secured to the side of the lathe bed. Slideably mounted in a second bore 75 formed in the brake block at right angles to the bore 73 and communicating therewith is a push rod 76 whose upper end is arranged to bear on the brake rod 71 and which has an adjusting screw 77 at its lower end bearing on a brake operating lever 78. This lever is pivoted at one end on a pivot pin 79 projecting from the lathe bed and has its opposite end pivoted at 80 to the plunger 81 of a brake solenoid 82 fixed to the lathe bed. The brake solenoid 82 is connected in series circuit with the micoswitch 40 and push-button switch 39 so that actuation of the latter also energises the brake solenoid, whereupon the brake lever 78 urges the push rod 76 against the brake rod 71 in order to clamp the latter in the bore 73 and restrain movement of the headstock 2. The components of the headstock braking device 70 mounted on the side of the lathe bed are protected by a housing 83.

In order to cut an aspherical surface, for example, of a contact lens, a cylindrical lens blank is clamped in the collet 8 coaxially with the spindle axis 4*a*, the slides 11, 14 of the radius cartridge 9 are adjusted to centralise the cutting point 12*a* of the tool and position it at an appropriate radius, and the eccentric mechanism 18 is adjusted to provide the required amount of deviation from true spherical for the surface to be cut. To adjust the eccentric mechanism 18, the radius cartridge is turned to align the tool 12 with the spindle axis 4*a* and this actuates the microswitch 40, whereupon the press-button switch 39 can be operated to energise the eccentric and brake solenoids 33, 82. When the switch 39 is operated, the headstock 2 is locked in position and the eccentric mechanism 18 is unlocked so that the leadscrew 5 can be turned to move the leadscrew reaction block 49 and, hence, the lower side 21 of the eccentric mechanism without moving the headstock. Thus, the leadscrew can be used to adjust the eccentricity of the pivot 23 which determines the stroke of the headstock 2 and the deviation of the cutting operation from true spherical.

Having set the radius cartridge and eccentric mechanism to the required parameters, the push-button switch 39 is operated to lock the eccentric mechanism in its set position and unlock the headstock, whereafter the latter can be advanced by actuation of the leadscrew 5 to position the end of the lens blank in contact with the cutting tool 12. With the spindle 4 rotating, the radius cartridge 9 is then turned with the aid of its handle 13 so as to swing the cutting tool along its preset arc of movement through the centre of the blank and, in response to the movement of the radius cartridge, the headstock is simultaneously reciprocated parallel to the axis 4*a* of the spindle in synchronism with the oscillations of the cutting tool. As each increment of material is removed from the end face of the blank by the cutting tool, the tool is returned to its central position and, whilst stationary, the headstock is advanced independently of the reciprocating motion of the headstock by turning the leadscrew handle 54 in order to provide for the removal of the next increment of material from the blank, and so on until the desired surface has been cut in the blank. Thereafter, the blank may be removed from the collet 8, the cut surface may be adhered to a wax support, which is clamped in the collet 8, and another cooperating aspheric surface is cut on the opposite end of the blank in a similar manner to the first surface.

It can be shown that the lathe structure described above cuts an elliptical aspherical lens surface, the radius of curvature at the centre of the lens being a function of the eccentricity of the pivot pin 23 with respect to the axis 9*a* of the radius cartridge and the radius at which the cutting tool 12 is set. Also, the axial edge lift at any diameter can be calculated using the same parameters. Alternatively, the elliptical eccentricity can be set using these parameters. The difference in the readings of the dial indicator 60 at the position where the cutting tool 12 is in line with the spindle axis 4*a* and where it is at right angles to the spindle axis is the eccentricity of the pivot pin 23. Thus, the lathe can be set to cut any given elliptical surface with a particular radius of curvature at its centre and, having calculated or computed the parameters of a required elliptical surface, these can readily be set on the lathe by adjusting the radius cartridge 9 and the eccentric mechanism 18.

Whilst a particular embodiment has been described, it will be understood that modifications can be made without departing from the scope of the invention as defined by the accompanying claims. For example, instead of employing a mechanical connection between a manually-operated radius cartridge 9 and the headstock 2, in order to reciprocate the latter, the radius cartridge and headstock may be arranged to be moved by servo motors suitably linked by control circuitry so as to synchronise the movements of the radius cartridge and headstock. In another modification, the radius cartridge may be mounted for linear sliding movement in the axial direction of the headstock spindle 4 and may be arranged to be reciprocated in synchronism with the oscillations of the radius cartridge, instead of reciprocating the headstock. The latter may then be simply a standard headstock movable by a leadscrew so as to provide for positioning of a workpiece and incremental removal of material therefrom.

We claim:

1. A lathe for cutting an aspherical surface on a workpiece, comprising in combination:

headstock means having rotatable spindle means adapted to mount a workpiece for rotation about the axis of said spindle means, radius cartridge means including tool posts means and pivot means for said radius cartridge means, whereby said radius cartridge means is swingable on said pivot means and is adapted to move a cutting tool mounted in said tool post means in contact with said workpiece and along an arc of predetermined radius transversely to said spindle axis of said headstock means, said headstock means and said radius cartridge means being mounted for linear movement relatively to one another substantially parallel to said spindle axis of said headstock means, and coupling means coupled to said pivot means and operated in response to turning of said pivot means upon swinging of said radius cartridge means to produce and control linear displacement of said headstock means and said radius cartridge means relatively to one another, whereby said cutting tool mounted in said tool post means is arranged to cut a predetermined aspherical surface on said workpiece.

2. The lathe claimed in claim 1, wherein said means coupled to said pivot means is adjustable, to adapt said lathe to cut aspherical surfaces of different eccentricities.

3. The lathe of claim 1, further comprising control means for linearly displacing said headstock means and said radius cartridge means relatively to one another substantially parallel to said spindle axis of said headstock means and independently of said linear displacement produced by said coupling means, whereby to enable incremental removal of material from said workpiece mounted on said spindle means.

4. The lathe claimed in claim 3, wherein said headstock means is mounted for linear sliding movement parallel to said spindle axis thereof and said control means is operable to control said sliding movement of said headstock means, and wherein said coupling means links said pivot means of said radius cartridge means to said control means to provide for simultaneous swinging movement of said cartridge means and linear displacement of said headstock means.

5. The lathe claimed in claim 4, wherein said control means is a leadscrew means mounted substantially parallel to said spindle axis of said headstock means and coupled to said headstock means, whereby rotation of said leadscrew means produces linear sliding movement of said headstock means, and wherein said leadscrew means is journalled in bearing means which is mounted for linear reciprocating movement substantially parallel to said spindle axis and is linked to said pivot means of said radius cartridge means by said coupling means, whereby swinging movement of said radius cartridge means produces linear reciprocating movement of said bearing means and, hence, said headstock means.

6. A lathe for cutting an aspherical surface on a workpiece, comprising in combination:

headstock means having rotatable spindle means adapted to mount a workpiece for rotation about the axis of said spindle means, tool carriage means mounting tool post means and having pivot means disposed substantially perpendicularly to said axis of said spindle means, whereby said tool carriage means is swingable on said pivot means and is adapted to move a cutting tool mounted in said tool post means in contact with said workpiece and along an arc of predetermined radius transversely to said spindle axis of said headstock means, said headstock means and said tool carriage means being mounted for linear movement relatively to one another and substantially parallel to said spindle axis of said headstock means, control means for linearly displacing said headstock means and said tool carriage means relatively to one another to provide for incremental removal of material from said workpiece mounted on said spindle means, and coupling means coupled to said pivot means of said tool carriage means and operated by said pivot means in response to turning thereof, upon swinging movement of said tool carriage means, to produce linear reciprocating movement of said headstock means and said tool carriage means relatively to one another and independently of said linear displacement produced by said control means, whereby the axial position of said workpiece relatively to said cutting tool is correlated to the angular position of said tool carriage means relatively to said spindle axis and said cutting tool mounted in said tool post means is arranged to cut a predetermined aspherical surface on said workpiece.

7. A lathe for cutting an elliptical surface on a workpiece, comprising in combination:

headstock means having rotatable spindle means adapted to mount a workpiece for rotation about the axis of said spindle means, means mounting said headstock means for linear movement substantially parallel to said spindle axis of said headstock means, control means for linearly moving said headstock means, tool carriage means mounting tool post means and having pivot means disposed with its pivot axis substantially perpendicular to said spindle axis, whereby said tool carriage means is swingable on said pivot means and is adapted to move a cutting tool mounted in said tool post means in contact with said workpiece and along an arc of predetermined radius transversely to said spindle axis of said headstock means, adjustable coupling means connected to said pivot means of said tool carriage means and linking said pivot means to said control means, said coupling means being drivable by said pivot means in response to turning thereof, upon swinging of said tool carriage means, to produce linear reciprocating movement of said control means, and hence said headstock means, of a selected stroke and independently of said linerar movement produced by said control means, whereby the axial position of said workpiece relatively to said cutting tool is correlated to the angular position of said tool carriage means relatively to said spindle axis and a cutting tool mounted in said tool post means is arranged to cut a predetermined elliptical surface on said workpiece.

8. A lathe for cutting an aspherical surface on a workpiece, comprising in combination:

headstock means having rotatable spindle means adapted to mount a workpiece for rotation about the axis of said spindle means, said headstock means being mounted for linear sliding movement parallel to said spindle axis thereof, radius cartridge means including tool post means and pivot means for said radius cartridge means, whereby said radius cartridge means is swingable on said pivot means and is adapted to move a cutting tool mounted in said tool post means in contact with said workpiece and along an arc of predetermined radius transversely to said spindle axis of said headstock means, leadscrew means mounted substantially parallel to said spindle axis of said headstock means and coupled to said headstock means, whereby rotation of said leadscrew means produces linear sliding movement of said headstock means to provide for incremental removal of material from said workpiece mounted on said spindle means by said cutting tool mounted in said tool post means, bearing means rotatably mounting said leadscrew means and mounted for linear reciprocating movement substantially parallel to said spindle axis of said headstock means, and coupling means linking said pivot means of said radius cartridge means to said bearing means and movable in response to turning of said pivot means, upon swinging of said radius cartridge means, to produce linear reciprocating movement of said bearing means, and hence said headstock means, independently of linear sliding movement proudced by rotation of said leadscrew means, whereby said cutting tool mounted in said tool post means is arranged to cut a predetermined aspherical surface on said workpiece.

9. The lathe claimed in claim 8, wherein said coupling means comprises a connecting member linking said bearing means and pivot means of said radius cartridge means, and wherein said connecting member is coupled to said pivot means of said radius cartridge means via an eccentric mechanism including adjustable pivot means for said connecting member, said eccentric pivot means being adjustable radially relatively to said radius cartridge pivot means to enable setting of said eccentric pivot means at an appropriate eccentricity relatively to said radius cartridge pivot means to reciprocate said headstock means with a selected stroke for cutting a predetermined aspherical surface of said workpiece.

10. The lathe claimed in claim 9, wherein said eccentric pivot means has its axis disposed substantially parallel to the axis of said radius cartridge pivot means and is mounted thereon for sliding movement transversely to said radius cartridge pivot means and through a position in which said two axes are coaxial.

11. The lathe claimed in claim 9, further comprising locking means for selectively locking said eccentric pivot means in its adjusted position.

12. The lathe claimed in claim 11, wherein said locking means is arranged to be unlocked when the path of sliding movement of said eccentric pivot means is substantially parallel to said spindle axis of said headstock means, and second locking means is provided for locking said headstock means against sliding movement when said first locking means is unlocked, whereby to enable rotation of said leadscrew means to adjust the eccentricity of the said eccentric pivot means.

* * * * *